US009431751B2

(12) United States Patent
Sartori et al.

(10) Patent No.: US 9,431,751 B2
(45) Date of Patent: Aug. 30, 2016

(54) CONNECTOR HAVING A PIN GUIDE FOR USE WITH A PRINTED CIRCUIT BOARD

(71) Applicant: TYCO ELECTRONICS BRASIL LTDA, Sao Paulo (BR)

(72) Inventors: Marco Antonio Sartori, Sando Andrew/SP (BR); Amadeu Luiz Fazani Cavallieri, Campinas/SP (BR); Joao Antonio Marson, Braganca Paulista/SP (BR)

(73) Assignee: TYCO ELECTRONICS BRASIL LTDA, Sao Paulo (BR)

( * ) Notice: Subject to any disclaimer, the term of this patent is extended or adjusted under 35 U.S.C. 154(b) by 113 days.

(21) Appl. No.: 14/224,833

(22) Filed: Mar. 25, 2014

(65) Prior Publication Data

US 2015/0280335 A1 Oct. 1, 2015

(51) Int. Cl.

| | |
|---|---|
| ***H01R 12/00*** | (2006.01) |
| ***H01R 13/502*** | (2006.01) |
| ***H01R 12/72*** | (2011.01) |
| *H01R 13/41* | (2006.01) |

(52) U.S. Cl.

CPC ..... *H01R 13/502* (2013.01); *H01R 12/724* (2013.01); *H01R 13/41* (2013.01)

(58) Field of Classification Search

CPC .. H01R 13/502; H01R 12/724; H01R 13/41; H01R 23/7073

USPC ..... 439/79, 660, 695

See application file for complete search history.

(56) References Cited

U.S. PATENT DOCUMENTS

| | | | | |
|---|---|---|---|---|
| 4,491,376 | A | 1/1985 | Gladd et al. | |
| 4,697,864 | A | 10/1987 | Hayes et al. | |
| 4,723,196 | A * | 2/1988 | Hofmeister | H01R 12/7082 174/541 |
| 6,050,306 | A * | 4/2000 | Mitra | H01R 12/712 140/71 R |
| 6,161,283 | A * | 12/2000 | Tokuwa | H01R 12/716 29/876 |
| 6,409,533 | B1 | 6/2002 | Savage, Jr. | |

* cited by examiner

*Primary Examiner* — Khiem Nguyen

(57) ABSTRACT

A connector having a pin guide and method are disclosed. The connector includes a housing, terminals and a pin guide. The terminals include securing sections and substrate mating ends. The securing sections are positioned to maintain the terminals in the terminal receiving recesses. The substrate mating ends extend from the housing. The pin guide is removably attached to the housing, the pin guide having terminal receiving cavities for receiving the substrate mating ends of the terminals therein. The method of assembly and installing a connector includes: inserting terminals into housing; bending a portion of the terminals which extend outward from the housing; and positioning a pin guide over the bent ends of the terminals, whereby the bent ends are retained in cavities of the pin guide.

15 Claims, 6 Drawing Sheets

CONNECTOR HAVING A PIN GUIDE FOR USE WITH A PRINTED CIRCUIT BOARD

FIELD OF THE INVENTION

This invention relates generally to a retention guide for use with an electrical connector. In particular, the invention relates to a guide which facilitates the insertion of terminals on a printed circuit board

BACKGROUND OF THE INVENTION

It is common practice to make an electrical connection to a printed circuit board by means of an electrical header assembly which comprises a dielectric housing and a plurality of conductor terminals or pins. The conductor terminals are inserted into longitudinal cavities of the housing. The tail ends are then bent perpendicularly, in many instances over anvil portions of the housing, which locks the conductors in place and provides transversely projecting tails for electrical connection to the printed circuit board when the header assembly is attached. The printed circuit board has a precise pattern of holes which receives the projecting tails which are then soldered or otherwise secured to the printed circuit board to provide a good electrical interface. See, for instance, U.S. Pat. No. 3,864,000.

Another such header is shown in U.S. Pat. No. 4,491,376 which discloses a header assembly having a thermoplastic housing and two rows of metallic conductor pins is attached to a printed circuit board. The conductor pins have tails which are bent over anvil portions of the housing and project through slots in a locator plate at the conductor end of the housing. The locator plate slots have detents for retaining the bent tails in a pattern to facilitate assembly and soldering of the tails in a matching pattern of holes in the printed circuit board. Stress on the solder connections due to differential thermal expansion is reduced by flexure of the conductor pins in enlarged rearward cavity portions and slippage of the bent tails in the detents.

As described above, known connectors provide for locator plates and means for bending contacts. This is advantageous when the conductor pins of the terminals are to be soldered to the printed circuit board. However, if the conductor pins have compliant contact portions which make electrical connection to the printed circuit boards, the insertion of the pins into the openings of the printed circuit board requires force to be applied to the compliant portions. The locator plates currently used are not capable of cooperating with the compliant portions to provide such a force.

It would be beneficial to provide a pin retention guide for use with headers which provides sufficient force required to facilitate mating of the compliant pins to the circuit board, thereby eliminating the problems noted above. In addition, it would be beneficial to provide a retention guide which is separate from the header but which can easily be inserted onto the pins and mated to the header.

SUMMARY OF THE INVENTION

An embodiment is directed to a connector having a pin guide which includes a housing, terminals and the pin guide. The housing has terminal receiving recesses. The terminals include securing sections and substrate mating ends. The securing sections are positioned to maintain the terminals in the terminal receiving recesses. The substrate mating ends extend from the housing. The pin guide is removably attached to the housing, the pin guide having terminal receiving cavities for receiving the substrate mating ends of the terminals therein.

An embodiment is also directed to a connector having a pin guide which includes a housing, terminals and the pin guide. The housing has terminal receiving recesses. The terminals include securing sections and substrate mating ends. The securing sections are positioned to maintain the terminals in the terminal receiving recess. The substrate mating ends extend from the housing. The pin guide is removably attached to the housing. The pin guide has terminal receiving cavities for receiving the substrate mating ends of the terminals therein. Positioning recesses are provided proximate each cavity and have shoulders which cooperate with respective terminals. The positioning recesses are proximate a substrate mounting surface of the pin guide.

The substrate mating ends of the terminals may have lateral projections which are positioned in the positioning recesses of the pin guide to properly position the substrate mating ends. The lateral projections cooperate with the shoulders to transfer forces from the terminals to the pin guide when the terminals are mated with a mating substrate.

The method of assembly and installing a connector with a pin guide includes: inserting terminals into housing; bending a portion of the terminals which extend outward from the housing; and positioning the pin guide over the bent ends of the terminals, whereby the bent ends are retained in cavities of the pin guide.

The method may also include positioning projections of substrate mating ends of the terminals in positioning recesses of the pin guide, such that the substrate mating ends of the terminals are retained in position. Additional steps may include; inserting substrate mating portions of the substrate mating ends into openings of a mating substrate; and engaging shoulders of the positioning recesses with the projections of the terminals, whereby forces applied to the terminals during insertion are transferred to the housing.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
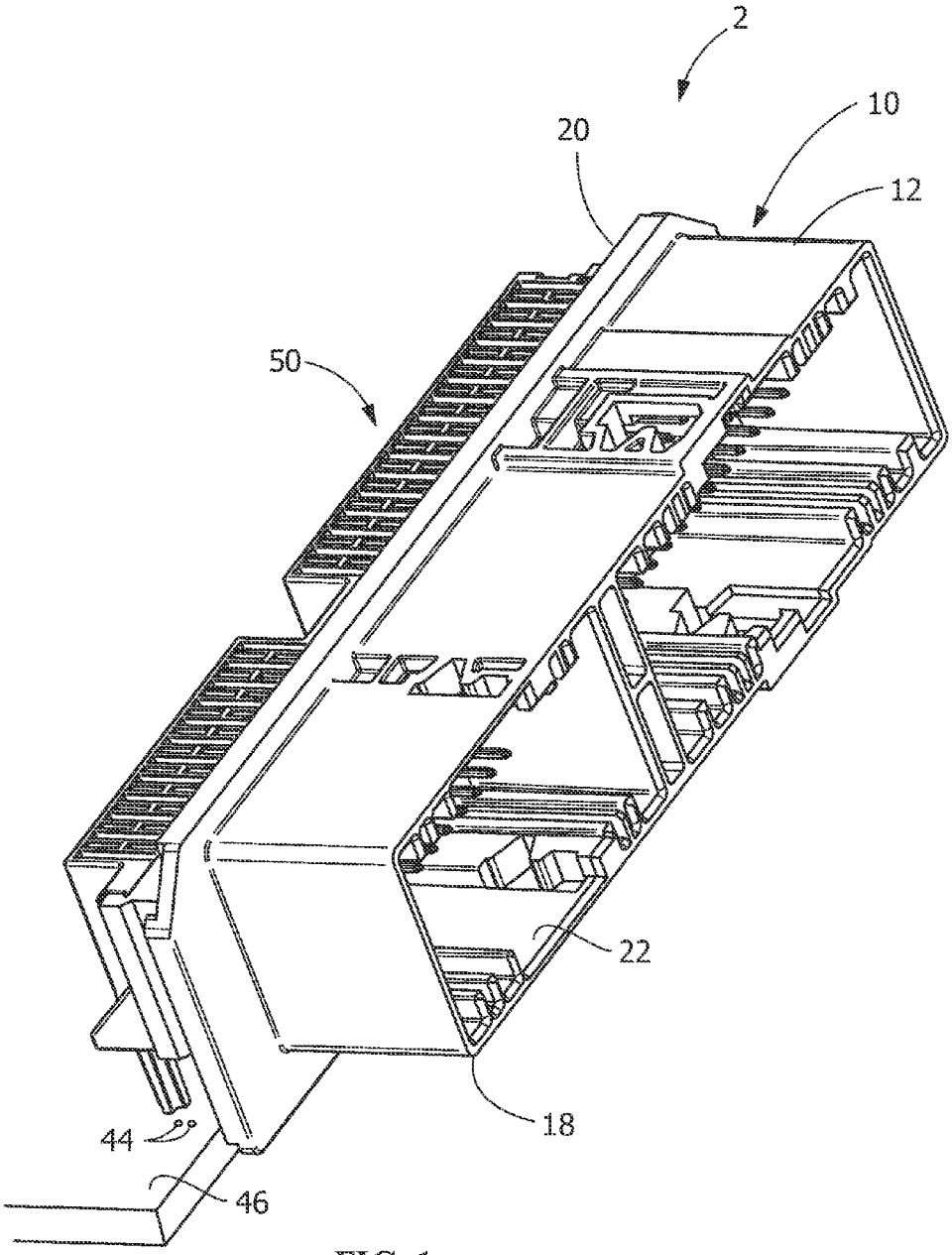
FIG. 1 is a perspective view of a connector with an embodiment of a pin guide provide thereon.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Figure 2:
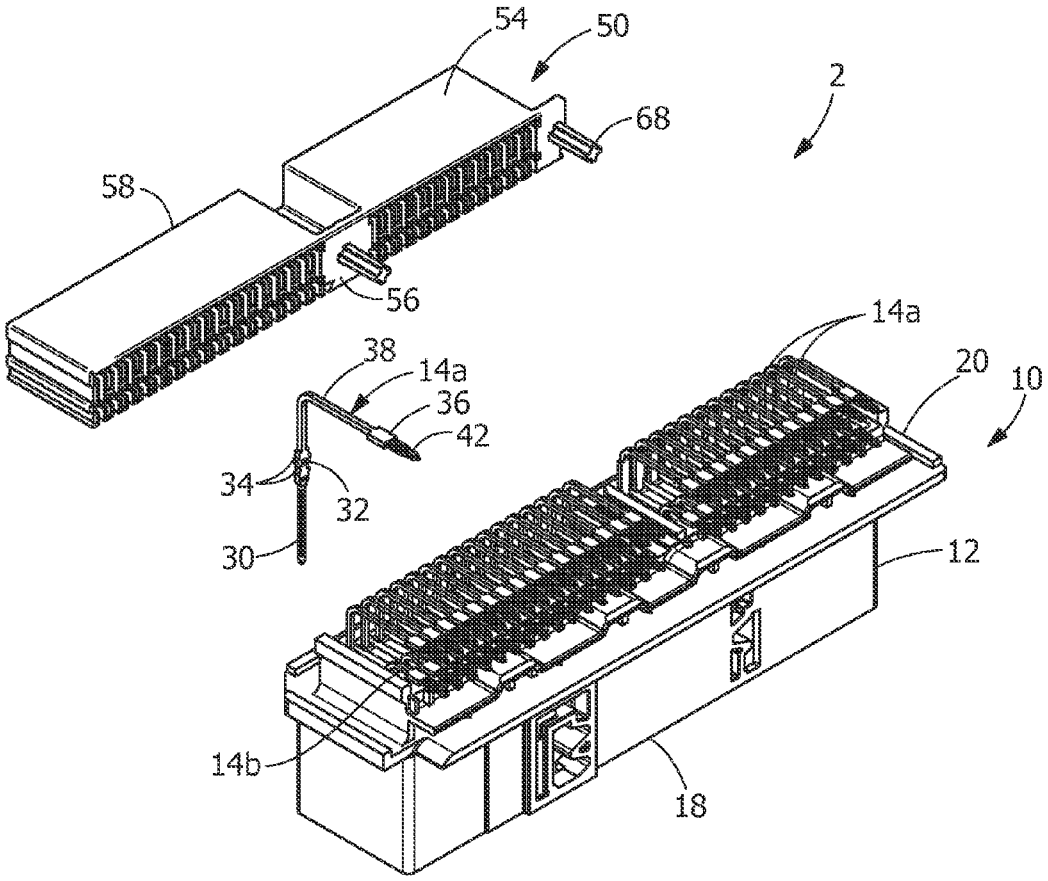
FIG. 2 is a perspective view of the connector of FIG. 1 with the pin guide exploded therefrom.

Referring now to FIGS. 1 and 2, a connector 2 includes an electrical header assembly 10 having a dielectric housing 12, made of thermoplastic material or other suitable material, and a plurality of conductor pins or terminals 14*a*, 14*b*. Conductor terminals 14*a*, 14*b* may be made from any suitable conductive materials which have the appropriate properties required to allow the terminals 14*a*, 14*b* to be mated and unmated over various cycles.

The housing 12 has two rows of longitudinal terminal receiving recesses which extend through the housing from a mating connector receiving end 18 to a conductor end 20. In the illustrative embodiment shown, the mating end 18 of the housing 12 has a socket portion 22 for mating with an appropriate plug-in connector. However, various numbers of rows and other configurations of the terminal receiving recess and the mating end 18 can be used without departing from the scope of the invention.

The housing 12 shown in FIGS. 1 and 2 is shown for illustrative purposes only. Many different housings can be used without departing from the scope of the invention.

The recesses are dimensioned to receive mating portions 30 of the conductor terminals 14*a*, 14*b* therein. In the illustrative embodiment shown, the mating ends 30 of the terminals 14*a*, 14*b* are preferably round and have tapered or pointed ends. Each terminal 14*a*, 14*b* has a connector securing section 32 provided proximate the mating portion 30. The connector securing sections 32 have projections or barbs 34 which extend therefrom.

Substrate mating ends or tail ends 38 extend from connector securing sections 32 and from the housing 12. The substrate mating ends or tail ends 38 are bent, as will be more fully described. The tail ends 38 have substrate mating portions 42, may have, but are not limited to, compliant section or barbs, which are dimensioned to cooperate with openings 44, such as, but not limited to, through holes of a mating substrate 46. The tail ends 38 of the terminals 14*a*, 14*b* have lateral projections 36 which extend therefrom. The lateral projections 36 are position between the securing sections 32 and the substrate mating portions 42.

Referring to FIGS. 1 through 7 an illustrative embodiment of a pin guide 50 of the connector 2 is shown. The pin guide 50 is configured to cooperate with terminals 14*a*, 14*b*, as will be more fully described. The pin guide 50 is made of thermoplastic material or other suitable material, which has the appropriate strength and non-conductive characteristics required.

Figure 3:
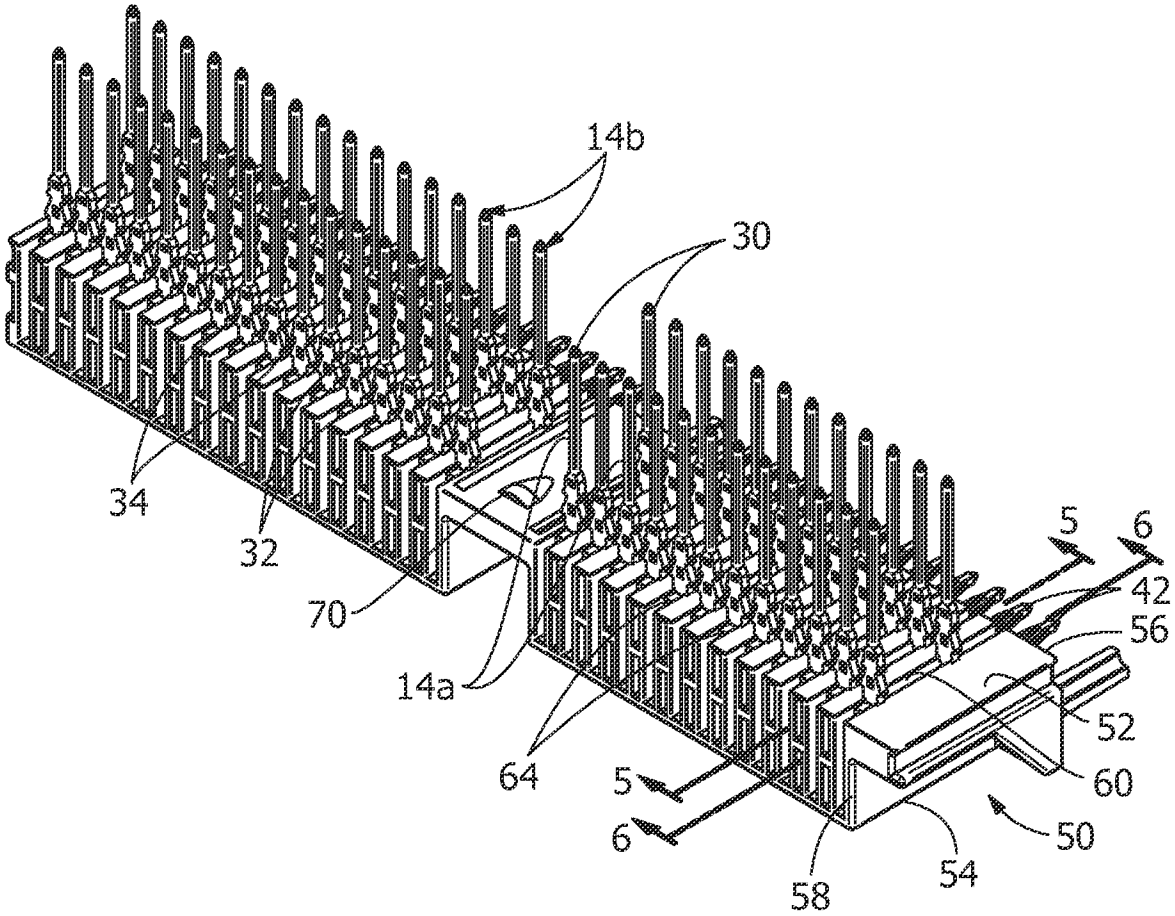
FIG. 3 is top perspective view of the pin guide with terminals inserted therein; the connector is not shown for purposes of illustration.
Figure 4:
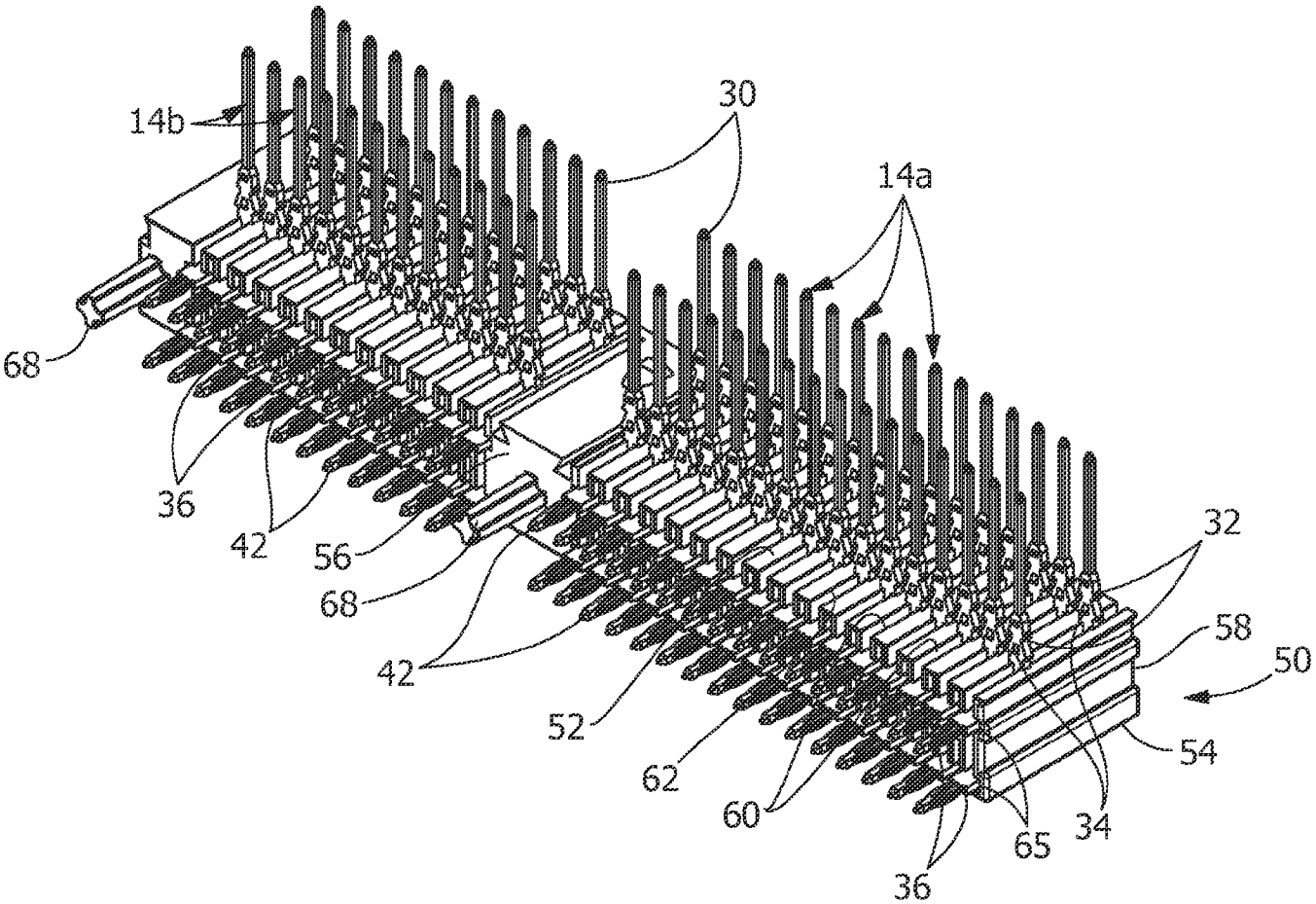
FIG. 4 is bottom perspective view of the pin guide with terminals inserted therein; the connector is not shown for purposes of illustration.

As best shown in FIGS. 3 and 4, the pin guide 50 has a header or housing mating surface 52 and an oppositely facing rear surface 54. A substrate mating surface 56 extends between the header mating surface 52 and the rear surface 54. In the embodiment shown, the substrate mating surface 56 is essentially perpendicular to the header mating surface 52, but other configurations can be used without departing from the scope of the invention. A top surface 58 extends between the header mating surface 52 and the rear surface 54 and is opposed to the substrate mating surface 56.

Figure 5:
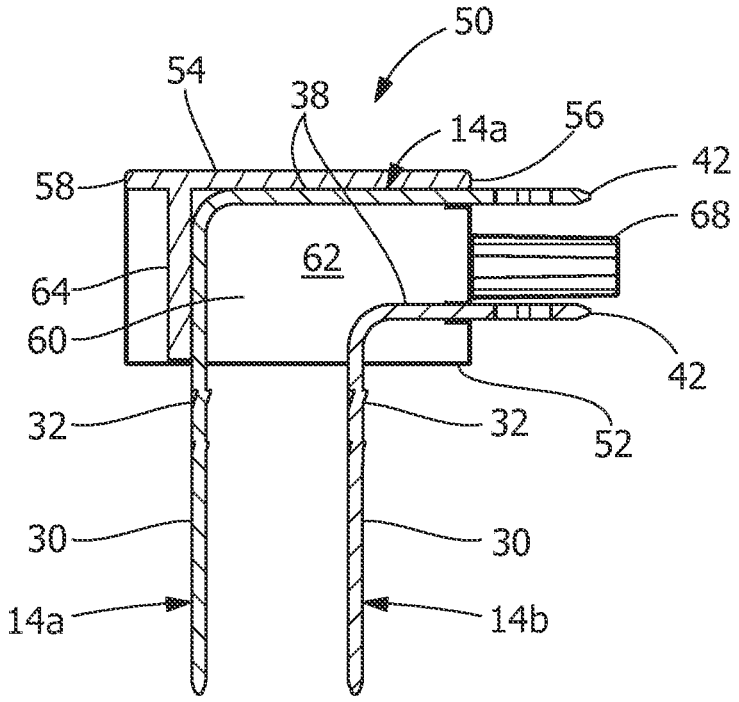
FIG. 5 is a cross-sectional view taken substantially along the line 5-5 of FIG. 3 and looking in the direction of the arrows.
Figure 6:
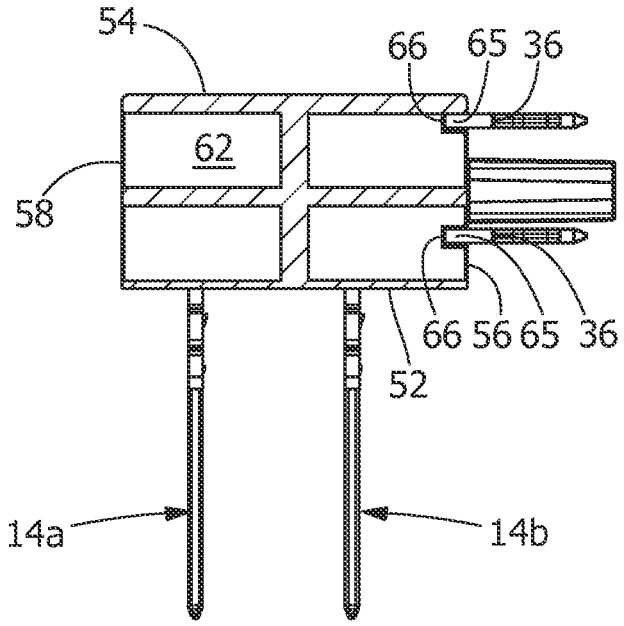
FIG. 6 is a cross-sectional view taken substantially along the line 6-6 of FIG. 3 and looking in the direction of the arrows.
Figure 7:
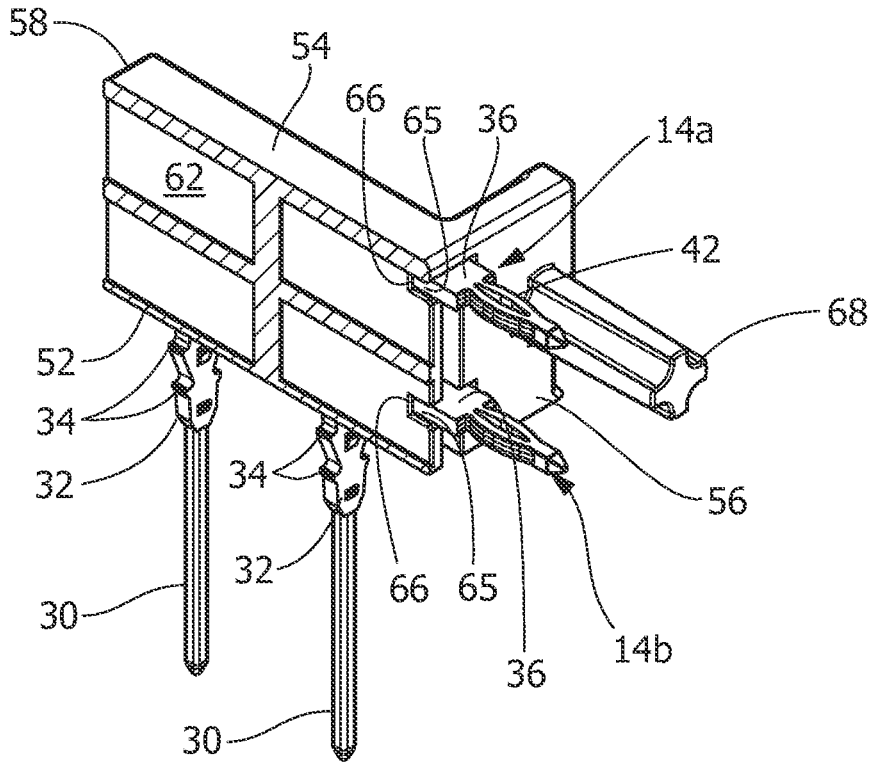
FIG. 7 is a perspective cross-sectional view showing lateral projections of the terminals positioned in recesses of the pin guide.

As best shown in FIG. 5, cavities or slots 60 extend from the header mating surface 52 toward the rear surface 54 and from substrate mating surface 56 toward the top surface 58. As best shown in FIGS. 6 and 7, walls 62 are provided between the cavities 60 to provide separation between the cavities 60 and to provide structural integrity to the pin guide 50. The walls 62 also cooperate with the terminals 14*a*, 14*b* to properly position the terminals 14*a*, 14*b* in respective cavities 60.

Referring again to FIG. 5, a supporting and positioning partition 64 is provided in each cavity 60. The partitions 64 are located proximate the top surface 58 and extend between respective walls 62. The partitions 64 provide positive support and positioning members which cooperate with respective terminals 14*a*, 14*b*, as will be more fully described.

Positioning recesses 65, as best shown in FIGS. 6 and 7, are provided proximate each cavity 60. The recesses 65 are located proximate the substrate mounting surface 56 and extend between respective cavities 60. The recesses 65 have supporting and positioning shoulders 66. The shoulders 66 are provided on the walls 62 and cooperate with respective terminals 14*a*, 14*b* to provide positive support and positioning, as will be more fully described.

As best shown in FIG. 4, extending from the substrate mating surface 56 in a direction away from the top surface 58 are mounting and alignment projections or posts 68. In the embodiment shown, two alignment posts 68 are provided; however, other configurations can be used without departing from the scope of the invention.

As best shown in FIG. 3, a locking projection 70 extends from the header mating surface 52 in a direction away from the rear surface 54. The locking projection 70 is configured and positioned to cooperate with a locking surface provided on the conductor end 20 of the housing 12 of the header 10.

As previously stated, in the illustrative embodiment shown, the housing 12 has two rows of recesses. As best shown in FIG. 2, each cavity in the upper row is aligned with a cavity in the lower row.

The conductor terminals 14*a*, 14*b* are straight when inserted into the recesses. Alternatively, the housing 12 may be overmolded over the terminals 14*a*, 14*b*. In the embodiment shown, the conductor terminals 14*a*, 14*b* in the lower row are assembled first. As the terminals 14*a*, 14*b* are inserted into the recesses, the projections 34 of the securing sections 32 engage the walls of the recesses to properly position and maintain the terminals 14*a*, 14*b* in the recesses. The tail ends 38 of these conductor terminals are then bent perpendicular or essentially perpendicular to the longitudinal axis of the recesses.

The conductor terminals 14*a*, 14*b* in the upper row are then assembled in like manner. As the terminals 14*a*, 14*b* are inserted into the recesses, the projections 34 of the securing sections 32 engage the walls of the recesses to properly position and maintain the terminals 14*a*, 14*b* in the recesses. The tail ends 38 of these conductor terminals 14*a*, 14*b* are then bent perpendicular or essentially perpendicular to the longitudinal axis of the recesses.

As best shown in FIGS. 1 and 2, the tail ends of the terminals in the upper row are in line, but spaced from the tail ends of the terminals in the lower row. The tail ends 38 of the terminals 14*a*, 14*b* in the upper row are spaced from the conductor end 20 of the housing 12 a greater distance that the tail ends 38 of the terminals 14*a*, 14*b* in the lower row, such that the substrate mating portions 42 of the tail ends 38 of the terminals 14*a* in the upper row are staggered from the substrate mating portions 42 of the tail ends 38 of the terminals 14*b* in the lower row.

While the embodiment shown and described has the tail ends 38 bent in a perpendicular direction, other embodiments may be used without departing from the scope of the invention. In addition, the terminals 14*a*, 14*b* in the upper row and lower row may be inserted and bent at the same time.

With the terminals 14*a*, 14*b* properly inserted into the recesses and bent according to the appropriate specifications, the pin guide 50 is inserted onto the terminals 14*a*, 14*b*.

Referring to FIGS. 1 through 4, the pin guide 50 has a plurality of longitudinal slots or cavities 60. The cavities 60 are dimensioned to be slightly thicker than the tail ends 38 of the terminals 14*a*, 14*b*. When the pin guide 50 is inserted onto the terminals 14*a*, 14*b*, each cavity 60 of the pin guide 50 is aligned vertically with a recess and its respective terminal 14*a*, 14*b* in the upper row of the housing 12 and a recess and its respective terminal 14*a*, 14*b* in the lower row.

Insertion of the pin guide 50 onto terminals 14*a*, 14*b* continues until the terminals 14*a*, which extend from the upper row, engage or are positioned proximate to the positioning partition 64 and the rear surface 54, as best shown in FIG. 5. In this position lateral projections 36 of the terminals 14*a*, 14*b* extending from both the upper row and the lower row are positioned in respective recesses 65 and engage respective shoulders 66, as best shown in FIGS. 6 and 7.

With the pin guide 50 fully inserted onto the terminals 14*a*, 14*b*, the pin guide is properly positioned relative to the housing 12. In this position, the locking projection 70 of the pin guide 50 engages the locking surface of the housing 12 to removably attach and maintain the pin guide 50 in position relative to the housing 12. In the illustrative embodiment shown, only one locking projection 70 is shown. However, additional locking projections can be provided without departing from the scope of the invention.

In the fully inserted position, the bends of the terminals 14*a* and 14*b* are housed in the pin guide 50. Terminals 14*a* are positioned proximate to or abutting partition 64 and rear surface 54. Positioned in each cavity 60 is one respective terminal 14*a* and one respective terminal 14*b*. Lateral projections 36 are positioned in respective recesses 64 and cooperate with respective shoulders 66.

With the pin guide 50 properly positioned relative to the terminals 14*a*, 14*b* and the housing 12, the header 10 and pin guide 50 are moved into position on a printed circuit board or substrate 46. The housing 12 may have lateral flanges for attaching the housing 12 to the printed circuit board 46 by suitable securing means. The printed circuit board 46 typically has upper and lower conductors which are electrically connected to the terminals 14*a*, 14*b* by the substrate mating portions 42 of the tail ends 38 which project from the substrate mating surface 56 of the pin guide 50. For this purpose, the substrate 46 has a predetermined pattern of holes 44 which receive the substrate mating portions 42 when the header 10 mated to the substrate 46.

As the connector 2 is moved into engagement with the substrate 46, the substrate mating portions 42 of the terminals 14*a*, 14*b* are moved into the through holes 44. The cooperation and positioning of the lateral projections 36 in the recesses 65 ensures that the substrate mating portions 42 are properly positioned relative to the through holes 44 of the substrate 46. As substrate mating portions 42 of the terminals 14*a*, 14*b* are moved into the through holes 44, the substrate mating portions 42 engage the walls of the through holes 44 to provide a reliable electrical connection between the plated through holes 44 and the terminals 14*a*, 14*b*.

As the substrate mating portions 42 are configured to either deform or exert pressure on the wall of the through holes 44, the amount of force required to insert the terminals 14*a*, 14*b* in the through holes 44 can be significant. It is, therefore, advantageous to provide a mechanism which protects the terminals 14*a*, 14*b* from damage and deformation as the substrate mating portions 42 are inserted into the through holes 44. The pin guide 50 provides such a mechanism.

As the substrate mating portions 42 are inserted in the through holes 44, the lateral projections 36 of the terminals 14*a*, 14*b* engage the shoulders 66 of the pin guide 50. In so doing, forces applied to the substrate mating portions 42 will be transferred to the housing of the pin guide 50 through the engagement of the lateral projections 36 with the shoulders 66. Consequently, forces/stresses associated with mating the terminals 14*a*, 14*b* to the substrate 46 are transferred to the housing of the pin guide 50 rather than through the relatively weak bends of the terminals 14*a*, 14*b*.

Additionally, the terminals 14*a*, 14*b* may cooperate with the supporting and positioning partition 64 to provide additional support to the terminals 14*a*, 14*b*, as insertion of the substrate mating portions 42 in the through holes 44 occurs.

The method of assembly and installing a connector includes: inserting terminals into housing; bending a portion of the terminals which extend outward from the housing; and positioning a pin guide over the bent ends of the terminals, whereby the bent ends are retained in cavities of the pin guide. The method may also include positioning projections of substrate mating ends of the terminals in recesses of the pin guide, such that the substrate mating ends of the terminals are retained in position. Additional steps may include; inserting substrate mating portions of the substrate mating ends into openings of a mating substrate; and engaging shoulders of the recesses with the projections of the terminals, whereby forces applied to the terminals during insertion are transferred to the housing.

The pin guide 50 accurately locates the tail ends 38 of the conductor terminals 14*a*, 14*b* which facilitates insertion of the tail ends 38 into through holes 44 in the circuit board 46 during assembly. In addition, as lateral projections 36 of the terminals 14*a*, 14*b* are maintained in position by recesses 65 and shoulder 66 of the pin guide 50, closer tolerances can be held between the tail ends 38 and the through hole patterns.

The use of the pin guide 50, which is a separate piece from the header, allows for ease of insertion of the terminals in the header and bending of the terminals thereafter. The pin guide also cooperates with the terminals to insure that a sufficient force can be applied to the header and the pin guide to facilitate mating of the compliant terminals to the circuit board. As the mating forces are transferred to the pin guide, the terminals are not damaged or deformed during mating, thereby providing a secure and reliable connection between the header and the printed circuit board. The use of the pin guide also protects the terminals during transportation of the header.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A connector having a pin guide, the connector comprising:

a housing having terminal receiving recesses;

terminals having securing sections and substrate mating ends, the securing sections maintain the terminals in the terminal receiving recesses, the substrate mating ends extend from the housing, the substrate mating ends having substrate mating portions, lateral projections positioned between the securing sections and the substrate mating portions;

the pin guide removably attached to the housing, the pin guide having terminal receiving cavities for receiving the substrate mating ends of the terminals therein, recesses provided proximate a substrate mounting surface of the pin guide, the recesses extend between terminal receiving cavities, the recesses have shoulders which cooperate with the lateral projections of the terminals;

the lateral projections of the terminals engage the shoulders of the recesses of the pin guide wherein as the substrate mating portions are inserted in the through holes of a substrate, forces applied to the substrate mating portions will be transferred to the pin guide through the engagement of the lateral projection with the shoulders of the recesses.

2. The connector as recited in claim 1, wherein the pin guide has a housing mating surface and an oppositely facing rear surface, the substrate mating surface extends between the housing mating surface and the rear surface.

3. The connector as recited in claim 2, wherein the substrate mating surface is essentially perpendicular to the housing mating surface.

4. The connector as recited in claim 3, wherein, a top surface extends between the housing mating surface and the rear surface and is opposed to the substrate mating surface.

5. The connector as recited in claim 4, wherein the terminal receiving cavities extend from the housing mating surface toward the rear surface and from substrate mating surface toward the top surface.

6. The connector as recited in claim 1, wherein walls are provided between respective cavities to provide separation between the respective cavities and to provide structural integrity to the pin guide, the walls cooperate with the terminals to properly position the terminals in respective cavities.

7. The connector as recited in claim 6, wherein partitions are provided in the cavities, the partitions extend between respective walls.

8. The connector as recited in claim 2, wherein alignment projections extend from the substrate mating surface.

9. The connector as recited in claim 2, wherein a locking projection extends from the housing mating surface, the locking projection cooperates with a locking surface provided on the housing.

10. The connector as recited in claim 1, wherein the substrate mating ends extend from the securing sections and are bent.

11. The connector as recited in claim 1, wherein the substrate mating ends have compliant substrate mating portions which are dimensioned to be cooperate with through holes of the mating substrate.

12. The connector as recited in claim 1, wherein the housing has two rows of terminal receiving recesses.

13. A connector having a pin guide, the connector comprising:

a housing having terminal receiving recesses;

terminals having securing sections and substrate mating ends, the securing sections maintain the terminals in the terminal receiving recesses, the substrate mating ends extend from the housing, the substrate mating ends having substrate mating portions, lateral projections positioned between the securing sections and the substrate mating portions;

the pin guide removably attached to the housing, the pin guide having terminal receiving cavities for receiving the substrate mating ends of the terminals therein, positioning recesses are provided proximate each cavity, the positioning recesses are proximate a substrate mounting surface of the pin guide, the positioning recesses have shoulders which cooperate with respective terminals;

the lateral projections of the terminals engage the shoulders of positioning recesses of the pin guide wherein as the substrate mating portions are inserted in the through holes of a substrate, forces applied to the substrate mating portions will be transferred to the pin guide through the engagement of the lateral projections with the shoulders of the positioning recesses.

14. The connector as recited in claim 13, wherein the lateral projections are positioned in the positioning recesses of the pin guide to properly position the substrate mating ends.

15. The connector as recited in claim 14, wherein a locking projection extends from a housing mating surface of the pin guide, the locking projection cooperates with a locking surface provided on the housing.

* * * * *